United States Patent [19]

Nishikawa et al.

[11] 4,320,956

[45] Mar. 23, 1982

[54] ELECTROPHOTOGRAPHIC APPARATUS INCLUDING A SCREEN MEMBER FOR DECREASING SIDE EDGE ELECTROSTATIC CHARGE

[75] Inventors: Masaji Nishikawa; Muneo Kasuga; Tomoki Funakubo, all of Hachioji, Japan

[73] Assignee: Olympus Optical Company Ltd., Tokyo, Japan

[21] Appl. No.: 128,563

[22] Filed: Mar. 10, 1980

[30] Foreign Application Priority Data

Mar. 12, 1979 [JP] Japan ..... 54-29248

[51] Int. Cl.[3] ..... G03G 15/00

[52] U.S. Cl. ..... 355/3 CH; 250/324

[58] Field of Search ..... 355/3 CH, 7, 14 CH; 250/324–326; 361/225, 230

[56] References Cited

U.S. PATENT DOCUMENTS

| | | | |
|---|---|---|---|
| 3,467,468 | 9/1969 | Johnson | 355/4 |
| 3,578,970 | 5/1971 | Michaud et al. | 355/3 CH |
| 3,827,799 | 8/1974 | Koizumi | 355/7 X |

FOREIGN PATENT DOCUMENTS

| | | | |
|---|---|---|---|
| 54-99634 | 8/1979 | Japan | 355/3 CH |

OTHER PUBLICATIONS

*IBM Tech. Disc. Bull.,* "Charge Corona Edge Shield", p. 2060, vol. 15, No. 7, Dec. 1972.

*Primary Examiner*—Richard L. Moses
*Attorney, Agent, or Firm*—Fleit & Jacobson

[57] ABSTRACT

An electrophotographic apparatus comprising a corona charger, a photosensitive and electrostatic-charge retentive drum including an electrically conductive substrate and a photosensitive layer having a narrower width than that of a record paper, and a screening member inserted between the corona charger and a peripheral part of the photosensitive and electrostatic-charge-retentive member for gradually decreasing a quantity of electrostatic charge charged at side edge portions of the photosensitive layer in a direction toward the side edges of the photosensitive layer, whereby black line and stripe can be prevented from appearing along the side edges of the record paper.

11 Claims, 11 Drawing Figures

ELECTROPHOTOGRAPHIC APPARATUS INCLUDING A SCREEN MEMBER FOR DECREASING SIDE EDGE ELECTROSTATIC CHARGE

BACKGROUND OF THE INVENTION

This invention relates to an electrophotographic apparatus comprising a photosensitive and electrostatic charge retentive member including an electrically conductive substrate and a photosensitive layer applied on the substrate, a corona charger for uniformly charging the photosensitive member, an optical system for projecting image of a document to be duplicated onto the photosensitive member to form an electrostatic latent image, a device for developing the electrostatic latent image to form a toned image, and a device for transferring the toned image onto a record paper.

In conventional electrophotographic apparatus, a width of the photosensitive layer on the photosensitive member, e.g. a photoconductive drum and a photoconductive endless belt, is made wider than the maximum permissible width of the record papers, and widths of active areas of various parts such as the uniformly charging device, optical system for projecting document image onto the photosensitive layer, toning device, transferring device, cleaning device and so on. On the other hand various types of electrophotographic apparatuses have been proposed in which a peeling claw or a peeling belt is used for peeling the record paper off the photosensitive drum after the toned image on the drum has been transferred onto the record paper, while the paper is urged against the drum. For this purpose there is often provided an inwardly stepped or depressed portion in the drum at each of its side edges, into which depressed portions the peeling claws are inserted. In case of liquid development the depressed portion is also used for draining excess liquid toning or developing agent. In an electrophotographic apparatus of this kind, the photosensitive layer is easily deteriorated or made dirty at the side edges against which the peeling claws or the peeling belts are urged or through which the excess toning agent flows, so that the width of the photosensitive layer applied on the conductive substrate is generally made slightly narrower than the maximum permissible width of record papers. In such an electrophotographic apparatus the inventors have found that undesired thin lines or thick stripes might appear in side edge portions of the record paper corresponding positionally to side edges of the photoconductive layer.

Such a blackening is caused by the fact that a thickness of the photosensitive coating layer is gradually decreased at the side edges, because it is quite difficult to apply uniformly the photosensitive layer on the electrically conductive substrate. When the document image is projected onto the photosensitive layer, its inclined side edge portions are insufficiently exposed to light and thus residual charge remains thereon. Therefore electric fields of high intensity are produced at the side edges and a relatively large amount of toners is attracted along side edges. These toners are transferred to the record paper, so that there are produced on the record paper black lines or stripes along its side edges. Further it is considered that a large amount of toners is liable to adhere to the side edge portions of the photosensitive layer during the development due to a so-called edge effect.

This blackening will be explained more in detail with reference to attached drawings hereinafter.

SUMMARY OF THE INVENTION

The present invention has for its object to provide a novel and useful electrophotographic apparatus which can avoid the above mentioned drawback of known apparatus and can offer a copy having good quality without the undesirable black lines or stripes along side edges.

According to the invention an electrophotographic apparatus comprises a photosensitive member having an electrically conductive substrate and a photosensitive layer which is applied on the substrate and has a width narrower than a record paper; a corona charger for uniformly charging the photosensitive member; an optical system for projecting an image of a document to be duplicated onto the uniformly charged photosensitive member to form an electrostatic latent image; a device for developing the latent image with toners to form a toned image; a device for transferring the toned image onto the record paper; and means for gradually decreasing the quantity of electrostatic change at side edge portions of the photosensitive member toward the side edges.

DESCRIPTION OF THE PREFERRED EMBODIMENTS

Figure 1A:
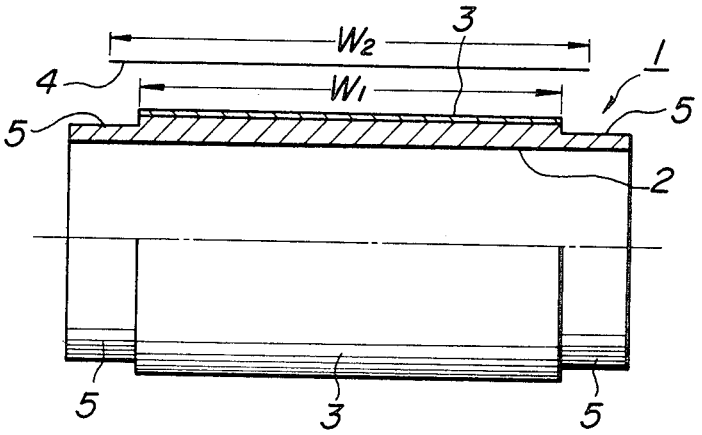
FIGS. 1A and 1B are schematic views showing relationship between a width of a photosensitive layer of a photosensitive drum and that of a record paper.
Figure 1B:
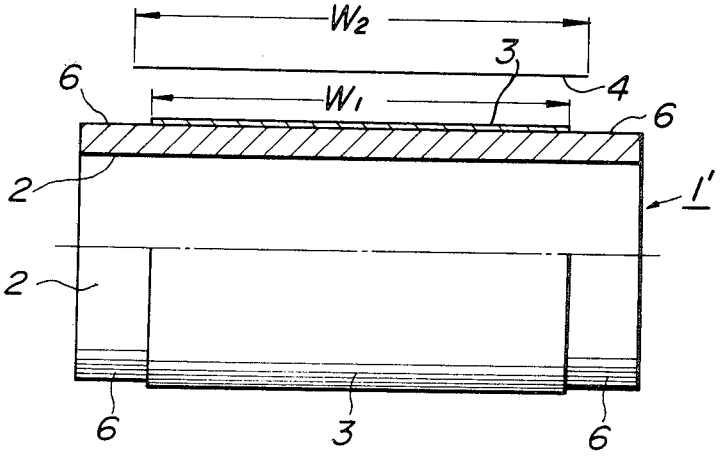

FIGS. 1A and 1B show two types of photosensitive drums 1 and 1' comprising an electrically conductive substrate 2 and a photosensitive layer 3 applied on the substrate. A width $W_1$ of the photosensitive layer 3 is made narrower than a width $W_2$ of a record paper 4. The substrate drum 2 shown in FIG. 1A has formed at its side edges inwardly stepped or depressed portions 5 against which peeling claws or peeling belts are urged for peeling the record paper 4 off the drum 1 after a toner image has been transferred thereon. The photosensitive layer 3 covers the remaining part of the substrate 2. The photosensitive drum 1' shown in FIG. 1B has no stepped or depressed portion at side portions 6 against which peeling claws or peeling belts are urged. The photosensitive layer 3 covers a central part of the drum-shaped substrate 2.

Figure 2A:
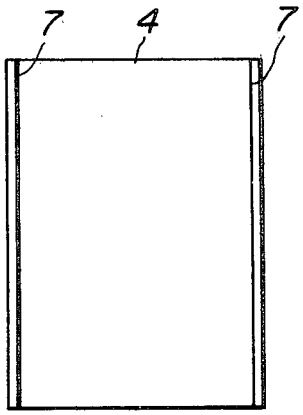
FIGS. 2A and 2B are schematic views illustrating black line and stripe formed on a record paper, respectively.
Figure 3A:
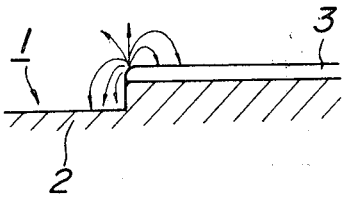
FIGS. 3A and 3B are schematic views for explaining causes of black line and stripe shown in FIGS. 2A and 2B, respectively.

When the duplication is carried out with the photosensitive drum 1 shown in FIG. 1A, thin black lines 7 appear along both side edges of the record paper 4 as shown in FIG. 2A. These lines 7 can be produced by development of the record paper 4 by a large amount of toners attracted in line on the photosensitive layer 3; because an inclination of side edge portions of the photosensitive layer 3 causes a large amount of electrostatic charge to remain at these portions due to the fact that the side edge portions are not sufficiently exposed to light, and this residual charge on the side edges produces a sharp concentration of lines of electric force (FIG. 3A). This means that there is a linearly distributed electric field which attracts toners in line at the end portion of the photosensitive layer 3. Moreover such irregular side edge portions mechanically attract much toners. This is also a cause of the black line.

Figure 2B:
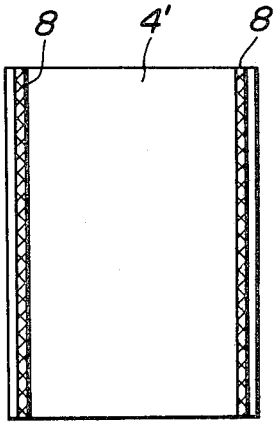
Figure 3B:
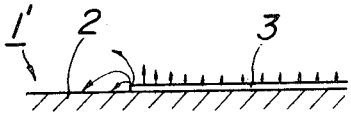

When duplication is effected with the photosensitive drum 1' shown in FIG. 1B, black stripes 8 appear on both edge areas of the record paper 4 as shown in FIG. 2B. These stripes 8 are formed by the so-called edge effect. This means that toners are attracted to the edge portions of the photosensitive layer 3 by an electric field of high intensity which is due to the fact that the electrically conductive substrate 2 at ground potential is closely located to the side edges (FIG. 3B). The width and density of the black stripes 8 vary according to the construction of an electrophotographic apparatus and amount of light used in exposure of the photosensitive layer 3. Sometimes the stripe has a width of 5 to 10 mm, but it is almost negligible when the residual charge on the photosensitive layer 3 at its side edges is small owing to sufficient quantity of light used in exposure. On the contrary, the black line 7 has a width of 0.1 to 0.3 mm but it is produced even when the exposure is effected with sufficient amount of light. In the case of insufficient amount of exposure light the black stripes as shown in FIG. 2B are produced as well.

Figure 4:
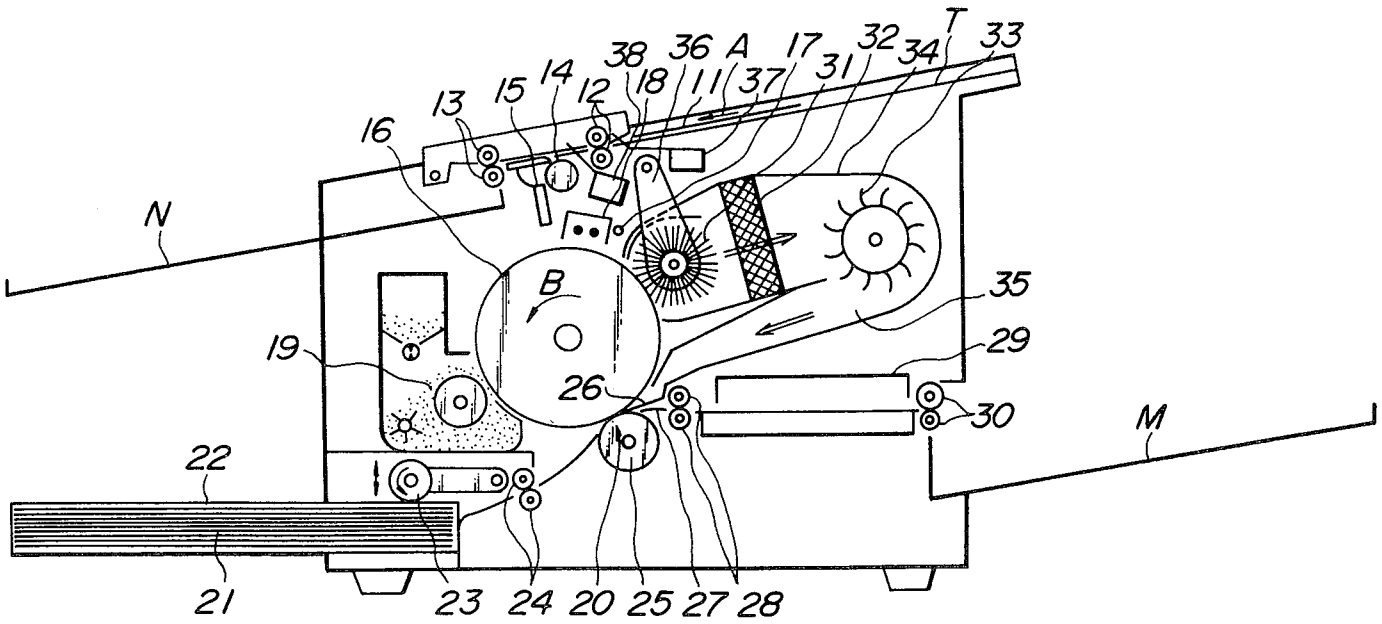
FIG. 4 is a schematic cross-sectional view showing an embodiment of an electrophotographic apparatus according to the invention.

FIG. 4 is a schematic cross-sectional view showing an embodiment of an electrophotographic apparatus according to the invention. In this apparatus a document 11 to be duplicated is placed on an inclined document table T and is inserted into a document feed device in a direction shown by an arrow A. The document feed device comprises feed rollers 12 and 13. During the travelling through the feed device the document 11 is illuminated by a lamp 14 and an image of document is projected by means of an optical system 15 onto a photosensitive drum 16 rotated at a constant speed in a direction of an arrow B. The drum 16 is first subjected to a charge erasing lamp 17 and is then uniformly charged by a corona charger 18. Upon the projection of the document image on the drum 16, an electrostatic latent image corresponding to the document image is formed thereon. The latent image is toned or developed with toner in a toner developing device 19 to form a visible toned image. The toned image thus formed is fed to a transfer section 20. On the other hand record papers 21 installed in a paper cassette 22 are picked-up one by one by means of a rotating and swinging pick-up roller 23 and are fed to the transfer section 20 by means of register rollers 24. In the transfer section 20 the record paper is fed between the drum 16 and a semiconductive transfer roller 25 to which a transferring bias voltage is applied and the toned image on the drum 16 is transferred onto a record paper 21. The record paper 21 having the transferred toned image thereon is separated from the drum surface with the aid of a peeling claw 26 and an air stream. Then the record paper 21 is transported along a guide 27 and is further fed by feed rollers 28 to a fixing device 29 of an oven heater type in which the toned image is fused onto the surface of the paper. The final copy thus obtained is discharged by discharge rollers 30 onto a copy tray M. The document 11 is discharged on a document tray N.

The toned image is not wholly transferred onto the record paper 21, but is partly remained on the drum 16 after the transfer and residual toner is erased by a rotating cleaning brush 31. Toner particles brushed off the drum 16 are collected by a filter 32 with the aid of an air stream produced by a fan 33. The brush 31, filter 32 and fan 33 are covered by a casing 34 so as to produce the sufficiently strong air stream. In this embodiment this air stream is also supplied to the transferring section 20 via a duct 35 and is used for peeling the record paper 21 off the photosensitive drum 16. Thus by the use of a fan for cleaning as a fan for producing an air stream peeling off the record paper 21, the construction of the apparatus is simplified and is made compact. In some cases, a number of copies can be produced from the same and single charge image once formed on the drum 16 by repeating the developing and transferring operations. For this purpose the charge image should be retained on the drum 16. Therefore the cleaning brush 31 is rotatably journaled to a swingable arm 36 and, during the copying operation of retention mode, the brush 31 is remained to be separated from the drum 16. Further the document feed device comprises a pair of document detecting switches 37 and 38 arranged on respective sides of the document feed rollers 12 and synchronous operation of various parts is controlled by document detection signals supplied from these detecting switches 37 and 38.

Figure 5A:
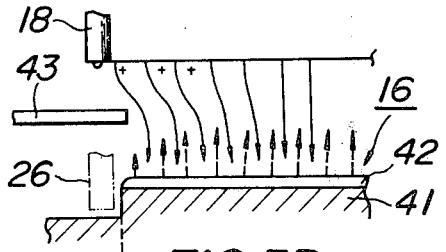
FIG. 5A is a schematic cross-sectional view of a part of the apparatus, which exhibits clearly an embodiment of a screening member

In an embodiment according to the present invention, the photosensitive drum 16 is constructed as shown in FIG. 5A (see also FIG. 1A). The photosensitive drum 16 comprises an electrically conductive cylindrical substrate 41 having stepped or depressed side edge portions against each of which the peeling claw 26 is urged, and a photosensitive layer 42 on the remaining portion of the cylindrical substrate 41.

Figure 5B:
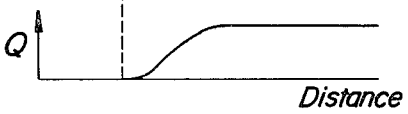
FIG. 5B is a graph showing a distribution of a quantity of electrostatic charge.

The width of the photosensitive layer 42 is made slightly narrower than the maximum permissible width of a recording paper. Furthermore there is provided a screening member 43 between the corona charger 18 and the photosensitive layer 42 of the drum 16 at both peripheries of drum 16. The screening member 43 is so arranged that it invades into corona ion paths as far as approximately 0.3 to 2.0 mm from an edge of the photosensitive layer 42. When the photosensitive layer 42 is charged under this condition, electrostatic charges charged on the photosensitive layer 42 are so distributed that no charge exists at the edge of the layer 42, and the quantity of the charge gradually increases in a range of approximately 0.5 to 2 mm from the edge and then becomes constant toward the center of the drum 16 as shown in FIG. 5B. Under such a distribution of electrostatic charge, an intensity of electric field produced by the electrostatic charge becomes gradually weaker in a direction toward the edge of the photosensitive layer 42, as schematically shown by broken lines in FIG. 5A, so that the side edge portions of the layer 42 are developed little. Therefore by the use of the apparatus according to this embodiment no undesirable line or stripe as shown in FIGS. 2A and 2B appear along side edges of the record paper. The quantity of charge at the side edge portions of the photosensitive layer 42 can be controlled by the charge on the screening member 43 given by corona ion flows in the case where the screening member 43 is made of electrically insulating material. In the case where the screening member 43 is made of electrically conductive material, the width of the corona ion flows can be adjusted by regulating an electrical potential of the conductive screening member 43; the width becomes narrower as the potential of the member 43 approaches to that of the corona beam. So in this case the width of corona ion flow can be arbitrarily adjusted by regulating a voltage of a bias voltage supply connected to the screening member 43.

A distance between the screening member 43 and a surface of the photoconductive layer 42 is preferably made approximately 1 to 5 mm. If the distance is smaller than 1 mm, the black stripe cannot be effectively prevented owing to the edge effect caused by a sharp rise of charge distribution, although the black line can be prevented owing to a decrease of charge quantity at the edge portions of the photoconductive layer 42. If the above mentioned distance is larger than 5 mm, a quantity of charge too gradually increases from the edge toward center of the photoconductive layer 42 so that an area is enlarged where any image cannot be printed by projection or a thin image is produced due to lack of charge, while an area decreases where an effective image can be printed.

Figure 6:
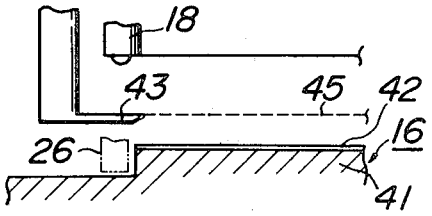
FIG. 6 is a schematic cross-sectional view of a part of the apparatus, which exhibits clearly another embodiment of a screening member.

FIG. 6 shows another embodiment according to the present invention. In this embodiment a scorotron having a control grid 45 is used as a corona charger 18 and a screening device 43 for adjusting a width of corona ion flows is closely attached to a lower surface of the grid 45. The inventors observed blackenings produced at the side edge portions of the record paper and effective image area with variously changing the thickness of the screening member 43 and the position of its edge relative to the photoconductive layer 42 under a condition that the control grid 45 is spaced from the surface of the photoconductive layer 42 by 2 mm and a bias voltage of +400 volts is applied to the grid 45. The result is as follows:

(1) In the case where the thickness of the screening member 43 is made 1 mm and its front edge is laid just above the edge of the photoconductive layer 42, an image was produced inside from a line apart from the edge of the photoconductive layer 42 by 1 mm. A black line is not produced. However, black stripes, although improved than the case without the screening member 43, were produced.

(2) In the case of the thickness of the screening member 43 of 0.5 mm and of the arrangement as in the case of (1), an image was produced inside from a line apart from the edge of the photoconductive layer 42 by about 0.5 mm. A black stripe was substantially invisible, while black lines were visible at some parts.

(3) In the case of the same thickness of the screening member 43 and that the position of its front edge is inside from the edge of the photoconductive layer 42 by about 0.3 mm, an image was produced inside from a line apart from the edge of the photoconductive layer 42 by 0.7 to 1 mm. Any black line was not produced and a black stripe was substantially insensible.

(4) In the case of the thickness of the screening member of 0.15 mm and of the same arrangement as that of (3), the result was substantially the same as that of (3).

From the experiments conducted with the apparatuses shown in FIGS. 5A and 6 the following conclusion can be obtained. A black line can be avoided by arranging so that corona ion flows may flow inside from a line apart from the edge of the photoconductive layer 42 by 0.5 mm or more, preferably 0.7 mm or more, while a black stripe can be avoided by arranging so that the distance between the lower surface of the screening member 43 and the surface of the photoconductive layer is 1 mm or more, advantageously 1.5 mm or more. A screening member having thickness of more than 0.5 mm can provide the same effect as that having thinner thickness if its front end portion is tapered as shown in FIG. 6. Although the screening member 43 can be provided upon the upper surface of the control grid 45 or apart from the control grid 45, a more accurate control can be obtained when the screening member is arranged below the grid 45, namely between the grid and the photoconductive layer 42. In the latter case, the electric field between the control grid 45 and the photoconductive layer 42 can be more accurately controlled under the influence of the grid 45.

Figure 7A:
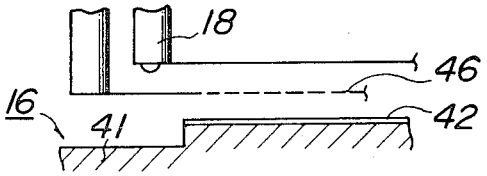
FIG. 7A is a schematic cross-sectional view of a part of the apparatus, which exhibits clearly further embodiment of a screening member.
Figure 7B:
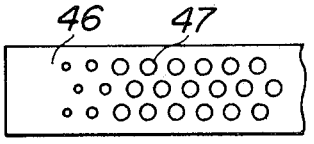
FIG. 7B is a plan view of the screening member shown in FIG. 7A.

FIG. 7A shows still further embodiment of the screening member according to the present invention. In this embodiment a scorotron is used as a corona charger 18 as in the case of FIG. 6. The difference lies in that its control grid functions as a screening member 43 as well. Such a control grid 46 can be constructed as shown in a plan view of FIG. 7B. A flat electrically conductive plate 46 is provided with a number of holes 47 for passing corona ion flows, the diameter of the hole 47 being made gradually smaller toward outside of the grid part at the side edge portions of the photoconductive layer 42. Such gradually smaller holes produce gradually smaller quantity of charge distributed at the end portion of the photosensitive layer 42.

As above mentioned, according to the present invention, an electrophotographic apparatus can be presented by which undesired black line and stripe on the record paper can be effectively avoided by a gradual decrease of quantity of electrostatic charge on a photosensitive layer toward the side edge portions of the photosensitive layer.

It should be noted that the present invention is not limited to the embodiments explained above, but many modifications can be conceived by those skilled in the art within the scope of the invention. For instance, in both the above embodiments an electrically conductive cylindrical substrate is provided with one or two stepped or depressed portions against which peeling claws are urged and the cylindrical substrate is covered with a photosensitive layer but for the stepped or depressed portion. However, the present invention can be effectively applied also to a photosensitive member or drum without a stepped portion (see FIGS. 1B and 3B).

What is claimed is:

1. An electrophotographic apparatus comprising:

a photosensitive member having an electrically conductive substrate and a photosensitive layer which is applied on the substrate and has a width narrower than a record paper;

a corona charger for uniformly charging the photosensitive member;

an optical system for projecting an image of a document to be duplicated onto the uniformly charged photosensitive member to form an electrostatic latent image;

a device for developing the latent image with toners to form a toned image;

a device for transferring the toned image onto the record paper;

a pair of screening members made of electrically conductive material and arranged at side edges of the photosensitive member, respectively, between the corona charger and the photosensitive member for gradually decreasing the quantity of electrostatic charge at the side edges of the photosensitive member toward the side edges; and a variable bias voltage supply source connected to said conductive screening members.

2. An electrophotographic apparatus as defined in claim 1, wherein said screening members inserted into corona ion paths by approximately 0.3 to 2.0 mm from the side edges of photosensitive layer.

3. An electrophotographic apparatus as defined in claim 1, wherein said screening members are made of electrically insulating material.

4. An electrophotographic apparatus as defined in claim 1, wherein a front end portion of said screening member has a taper and a thickness of the screening member is larger than 0.5 mm.

5. An electrophotographic apparatus comprising:

a photosensitive member having an electrically conductive substrate and a photosensitive layer which is applied on the substrate and has a width narrower than a record paper;

a corona charger of scorotron type having a control grid for uniformly charging the photosensitive member;

an optical system for projecting an image of a document to be duplicated onto the uniformly charged photosensitive member to form an electrostatic latent image;

a device for developing the latent image with toners to form a toned image;

a device for transferring the toned image onto the record paper; and a pair of screening members made of electrically conductive material and arranged at the side edges of the photosensitive member, respectively, between the corona charger and the photosensitive member for gradually decreasing the quantity of electrostatic charge at side edge portions of the photosensitive member toward the side edges.

6. An electrophotographic apparatus as defined in claim 5, wherein said screening member made of electrically conductive material is mechanically and electrically connected to said control grid.

7. An electrophotographic apparatus as defined in claim 5, wherein the screening member is arranged between the control grid and the photosensitive member.

8. An electrophotographic apparatus as defined in claim 5, wherein said screening member and said control grid are constructed in one single plate having a number of holes for passing corona ion flows, said holes being made gradually smaller in diameter toward the grid part above the side edge portions of the photosensitive layer.

9. An electrophotographic apparatus according to claims 1 or 5, wherein said screening member is made apart from a surface of said photosensitive layer by approximately 1 to 5 mm.

10. An electrophotographic apparatus according to claims 1 or 5, wherein said screening member causes corona ion flows to flow inside a line inwardly apart from the edge of said photosensitive layer by at least approximately 0.5 mm.

11. An electrophotographic apparatus as defined in claim 10, wherein said line is inwardly apart from said edge by at least approximately 0.7 mm.

* * * * *